US010753325B2

(12) United States Patent
Hayashi

(10) Patent No.: US 10,753,325 B2
(45) Date of Patent: Aug. 25, 2020

(54) INTAKE SOUND INTRODUCTION DEVICE

(71) Applicant: TOYOTA JIDOSHA KABUSHIKI KAISHA, Toyota-shi (JP)

(72) Inventor: Kenji Hayashi, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 324 days.

(21) Appl. No.: 15/848,347

(22) Filed: Dec. 20, 2017

(65) Prior Publication Data

US 2018/0238277 A1 Aug. 23, 2018

(30) Foreign Application Priority Data

Feb. 23, 2017 (JP) ..... 2017-032517

(51) Int. Cl.

| | |
|---|---|
| ***F02M 35/16*** | (2006.01) |
| ***F02M 35/12*** | (2006.01) |
| ***G10K 11/22*** | (2006.01) |
| ***G10K 11/172*** | (2006.01) |
| ***F02B 33/44*** | (2006.01) |
| ***G10K 11/24*** | (2006.01) |
| ***G10K 15/04*** | (2006.01) |

(Continued)

(52) U.S. Cl.

CPC ..... *F02M 35/1294* (2013.01); *F02B 33/44* (2013.01); *G10K 11/172* (2013.01); *G10K 11/24* (2013.01); *G10K 15/04* (2013.01)

(58) Field of Classification Search

CPC .... F02M 35/12; F02M 35/16; F02M 35/1294; F02M 35/1244; G10K 11/22; G10K 11/18; B60K 13/02

See application file for complete search history.

(56) References Cited

U.S. PATENT DOCUMENTS 6,848,410 B2 * 2/2005 Hoffmann ..... G10K 11/22 123/184.57
6,932,189 B2 * 8/2005 Helber ..... F01N 1/06 123/184.59

(Continued)

FOREIGN PATENT DOCUMENTS

| | | |
|---|---|---|
| CN | 105971783 A | 9/2016 |
| JP | 2014-185603 | 10/2014 |
| JP | 2017-89391 | 5/2017 |

*Primary Examiner* — Edgardo San Martin

(74) *Attorney, Agent, or Firm* — Oblon, McClelland, Maier & Neustadt, L.L.P.

(57) ABSTRACT

An introduction pipe has a first communication pipe, which is branched from a first intake passage and is connected to a resonator box, and a second communication pipe, which is branched from a second intake passage and is connected to the first communication pipe. The length of the first communication pipe between the branch point at which the first communication pipe is branched from the first intake passage and the connection point at which the second communication pipe is connected to the first communication pipe is defined as a first length. The length of the second communication pipe between the branch point at which the second communication pipe is branched from the second intake passage and the connection point at which the second communication pipe is connected to the first communication pipe is defined as a second length. The first length is unequal to the second length.

4 Claims, 3 Drawing Sheets

(51) Int. Cl.
*F02M 35/00* (2006.01)
*G10K 11/18* (2006.01)

(56) References Cited

U.S. PATENT DOCUMENTS

| | | | | |
|---|---|---|---|---|
| 7,077,093 | B2 * | 7/2006 | Koelmel | F02B 27/0236 123/184.57 |
| 7,090,048 | B2 * | 8/2006 | Albertson | F01N 1/02 181/237 |
| 7,353,791 | B2 * | 4/2008 | Sasaki | F02M 35/10019 123/184.53 |
| 7,448,353 | B2 * | 11/2008 | Shinada | F02M 35/04 123/184.53 |
| 7,506,626 | B2 * | 3/2009 | Sasaki | F02M 35/1294 123/184.53 |
| 7,621,370 | B2 * | 11/2009 | Abe | F02M 35/10137 123/184.57 |
| 7,717,230 | B2 * | 5/2010 | Takeuchi | F02M 35/1294 123/184.53 |
| 8,127,888 | B1 | 3/2012 | Mah | |
| 9,926,896 | B2 * | 3/2018 | Nakashima | F02M 35/1294 |
| 10,190,552 | B2 * | 1/2019 | Tarabra | F02M 35/10373 |
| 2002/0157897 | A1 * | 10/2002 | Hofmann | F02B 77/13 181/214 |
| 2004/0094112 | A1 | 5/2004 | Hoffmann et al. | |
| 2009/0000587 | A1 * | 1/2009 | Seko | F02M 35/1255 123/184.57 |
| 2014/0284136 | A1 | 9/2014 | Takahashi et al. | |
| 2016/0265479 | A1 | 9/2016 | Nakashima et al. | |
| 2016/0333832 | A1 | 11/2016 | Takahashi et al. | |

* cited by examiner

INTAKE SOUND INTRODUCTION DEVICE

BACKGROUND OF THE INVENTION

The present invention relates to an intake sound introduction device.

Intake sound introduction devices have been known, which introduce intake sound from the internal combustion engine mounted in a vehicle into the passenger compartment. For example, an intake sound introduction device described in Japanese Laid-Open Patent Publication No. 2014-185603 includes a Sound Creator (registered trademark). The Sound Creator functions as a resonator box for resonating intake sound of an internal combustion engine. The intake sound introduction device also includes a communication pipe, which is branched from the intake passage and is connected to the resonator box, and a transmission pipe, which is connected to the resonator box and communicates with the interior of the passenger compartment.

In some cases, powerful sound that contains half-order components, or so-called rumbling sound, is desired as the intake sound that is introduced into the passenger compartment. In such a case, such powerful intake sound is desired to be produced by the above-described intake sound introduction device, which has the resonator box.

SUMMARY OF THE INVENTION

Accordingly, it is an objective of the present invention to provide an intake sound introduction device capable of producing powerful intake sound that contains half-order components.

To achieve the foregoing objective and in accordance with one aspect of the present disclosure, an intake sound introduction device is provided that introduces an intake sound from an internal combustion engine mounted in a vehicle into a passenger compartment. The device includes a resonator box, an introduction pipe, which introduces the intake sound to the resonator box, and a transmission pipe, which allows the resonator box and the interior of the passenger compartment to communicate with each other. The introduction pipe includes a first communication pipe, which is branched from an intake passage of the engine and is connected to the resonator box, and a second communication pipe, which is branched from the intake passage and is connected to the first communication pipe. A length of the first communication pipe between a branch point at which the first communication pipe is branched from the intake passage and a connection point at which the second communication pipe is connected to the first communication pipe is defined as a first length. A length of the second communication pipe between a branch point at which the second communication pipe is branched from the intake passage and the connection point at which the second communication pipe is connected to the first communication pipe is defined as a second length. The first length is unequal to the second length.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An intake sound introduction device 100 according to one embodiment will now be described with reference to FIG. 1.

Figure 1:
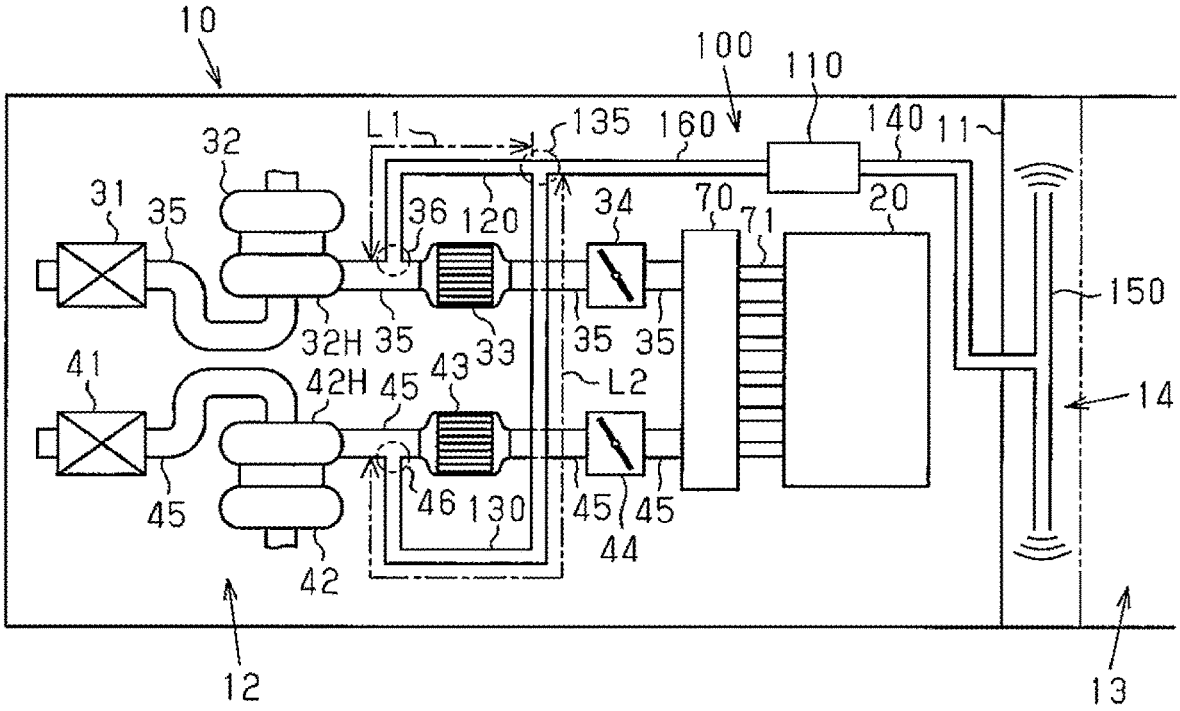
FIG. 1 is a schematic diagram representing an intake system of a vehicle that has an intake sound introduction device according to one embodiment of the present invention.

As illustrated in FIG. 1, an engine compartment 12 is arranged in a front section of a vehicle 10. A dash panel 11, which separates a passenger compartment 13 from the engine compartment 12, is arranged rearward from the engine compartment 12.

An internal combustion engine 20 is mounted in the engine compartment 12. The engine 20 is connected to an intake manifold 71, which introduces intake air to respective cylinders. The upstream end of the intake manifold 71 is connected to a surge tank 70.

The engine 20 has two exhaust-driven forced-induction devices. An intake unit of each of the forced-induction devices is arranged in a corresponding one of a first intake passage 35 and a second intake passage 45, which are independent of each other.

In the first intake passage 35, a first air cleaner 31, a first compressor housing 32H, a first intercooler 33, and a first throttle body 34 including a throttle valve are arranged in this order from the upstream side. The first compressor housing 32H accommodates a compressor of an exhaust-driven first forced-induction device 32. The downstream end of the first intake passage 35 is connected to the surge tank 70.

As in the first intake passage, a second air cleaner 41, a second compressor housing 42H, a second intercooler 43, and a second throttle body 44 including a throttle valve are arranged in the second intake passage 45 in this order from the upstream side. The second compressor housing 42H accommodates a compressor of an exhaust-driven second forced-induction device 42. The downstream end of the second intake passage 45 is connected to the surge tank 70.

The intake sound introduction device 100, which introduces intake sound from the engine 20 into a passenger compartment 13, is arranged in the engine compartment 12. The intake sound introduction device 100 has a resonator box 110, an introduction pipe 160, which introduces the intake sound to the resonator box 110, a transmission pipe 140, which allows the resonator box 110 to communicate with the interior of the passenger compartment 13, and an extension pipe 150. The extension pipe 150 is arranged in a dashboard 14 in the passenger compartment 13.

The resonator box 110 causes the intake sound produced in an intake passage of the engine 20 to resonate, thus amplifying the intake sound. For example, a Sound Creator (registered trademark) from MAHLE Filter Systems Corporation may be employed as the resonator box. The introduction pipe 160 has a first communication pipe 120, which is branched from the intake passage and is connected to the resonator box 110, and a second communication pipe 130, which is branched from the intake passage and is connected to the first communication pipe 120.

The first communication pipe 120 is branched from a section of a first intake passage 35 between the first compressor housing 32H and the surge tank 70 and is connected to the resonator box 110. For example, in the present embodiment, the first communication pipe 120 is branched from a section of the first intake passage 35 between the first compressor housing 32H and the first intercooler 33. In this case, as long as the first communication pipe 120 is branched from a section of the first intake passage 35 between the first compressor housing 32H and the surge tank 70, the branch point at which the first communication pipe 120 is branched from the first intake passage 35 may be changed as needed.

The second communication pipe 130 is branched from a section of a second intake passage 45 between the second compressor housing 42H and the surge tank 70 and is connected to the first communication pipe 120. For example, in the present embodiment, the second communication pipe 130 is branched from a section of the second intake passage 45 between the second compressor housing 42H and the second intercooler 43. In this case, as long as the second communication pipe 130 is branched from a section of the second intake passage 45 between the second compressor housing 42H and the surge tank 70, the branch point at which the second communication pipe 130 is branched from the second intake passage 45 may be changed as needed.

The length of the first communication pipe 120 between a first branch point 36 at which the first communication pipe 120 is branched from the first intake passage 35 and a connection point 135, at which the second communication pipe 130 is connected to the first communication pipe 120, is defined as a first length L1. The length of the second communication pipe 130 between a second branch point 46 at which the second communication pipe 130 is branched from the second intake passage 45 and the connection point 135, at which the second communication pipe 130 is connected to the first communication pipe 120, is defined as a second length L2. The first length L1 of the first communication pipe 120 is unequal to the second length L2 of the second communication pipe 130. The second length L2 is equal to the entire length of the second communication pipe 130.

The transmission pipe 140 extends through the dash panel 11. The open end of the transmission pipe 140 that is arranged in the engine compartment 12 communicates with the resonator box 110. The open end of the transmission pipe 140 that is arranged in the passenger compartment 13 communicates with the extension pipe 150. The extension pipe 150 extends in the vehicle width direction in the passenger compartment 13 (in the dashboard 14). The opposite ends of the extension pipe 150 are open to expose the interior of the extension pipe 150 to the atmospheric air. Alternatively, the interior of the extension pipe 150 may be exposed to the atmospheric air by forming a hole in the outer peripheral surface of the extension pipe 150.

An operation of the intake sound introduction device 100 will now be described.

The intake sound in the first intake passage 35 and the intake sound in the second intake passage 45 are transmitted to the resonator box 110 through the introduction pipe 160. The resonator box 110 amplifies the intake sound. The intake sound, which has been amplified by the resonator box 110, is introduced into the dashboard 14 in the passenger compartment 13 through the transmission pipe 140 and is thus transmitted to the extension pipe 150. The intake sound, which has been transmitted to the extension pipe 150, is transmitted to the interior of the dashboard 14 from the opposite ends of the extension pipe 150 and thus reaches the interior of the passenger compartment 13.

The introduction pipe 160 has the first communication pipe 120 and the second communication pipe 130. The first length L1 of the first communication pipe 120 is unequal to the second length L2 of the second communication pipe 130. The intake sound in the introduction pipe 160 thus becomes powerful sound that contains half-order components, which is rumbling sound, due to the pressure interference caused by the different pipe lengths. The rumbling sound is amplified by the resonator box 110 before reaching the interior of the passenger compartment 13.

The first communication pipe 120 may be branched from a section of the first intake passage 35 upstream of the first compressor housing 32H. In this case, the vibration of the air transmitted to the upstream side from the surge tank 70 is attenuated by the compressor of the first forced-induction device 32. This lowers the sound pressure of the air transmitted to the interior of the first communication pipe 120, thus reducing the volume of the intake sound.

However, in the present embodiment, the first communication pipe 120 is branched from a section of the first intake passage 35 between the first compressor housing 32H and the surge tank 70. As a result, the vibration of the air is transmitted to the interior of the first communication pipe 120 before being subjected to the attenuating effect by the compressor. The volume of the intake sound transmitted to the interior of the first communication pipe 120 is not reduced. Also, the second communication pipe 130 is branched from a section of the second intake passage 45 between the second compressor housing 42H and the surge tank 70. From the same reason as the above-described reason, the volume of the intake sound transmitted to the interior of the second communication pipe 130 is not reduced.

The open end of the transmission pipe 140 that is arranged in the passenger compartment 13 communicates with the extension pipe 150, which extends in the vehicle width direction. The intake sound that has been transmitted to the transmission pipe 140 is thus transmitted in the vehicle width direction through the extension pipe 150. In the passenger compartment 13, the driver seat and a passenger seat are aligned in the vehicle width direction. As a result, the above-described configuration allows the intake sound to easily reach the proximity of the driver seated on the driver seat and the proximity of the occupant seated on the passenger seat.

The above-described embodiment achieves the following advantages.

(1) The introduction pipe 160 has the first communication pipe 120 and the second communication pipe 130. The first length L1 of the first communication pipe 120 is unequal to the second length L2 of the second communication pipe 130. This allows the intake sound introduction device 100 to produce powerful sound that contains half-order components.

(2) The first communication pipe 120 is branched from a section of the first intake passage 35 between the first compressor housing 32H and the surge tank 70. The volume of the intake sound transmitted to the interior of the first communication pipe 120 is thus not reduced. Similarly, the second communication pipe 130 is branched from a section of the second intake passage 45 between the second compressor housing 42H and the surge tank 70. The volume of the intake sound transmitted to the interior of the second communication pipe 130 is thus also not reduced.

(3) The open end of the transmission pipe 140 arranged in the passenger compartment 13 communicates with the extension pipe 150, which extends in the vehicle width direction. This allows the intake sound to easily reach the proximity of the driver of the vehicle and the proximity of the occupant seated on a passenger seat.

The above-described embodiment may be modified as follows.

The first communication pipe 120 may be branched from a section of the first intake passage 35 upstream of the first compressor housing 32H. Also in this case, the second communication pipe 130 achieves the advantage (2). Further, the second communication pipe 130 may be branched from a section of the second intake passage 45 upstream of the second compressor housing 42H. Even in this case, the first communication pipe 120 achieves the advantage (2).

The first communication pipe 120 may be branched from a section of the first intake passage 35 upstream of the first compressor housing 32H and the second communication pipe 130 may be branched from a section of the second intake passage 45 upstream of the second compressor housing 42H. Also in this case, the advantages (1) and (3) are achieved.

In the first intake passage 35, the position of the first intercooler 33 and the position of the first throttle body 34 may be switched. Similarly, in the second intake passage 45, the position of the second intercooler 43 and the position of the second throttle body 44 may be switched.

Figure 2:
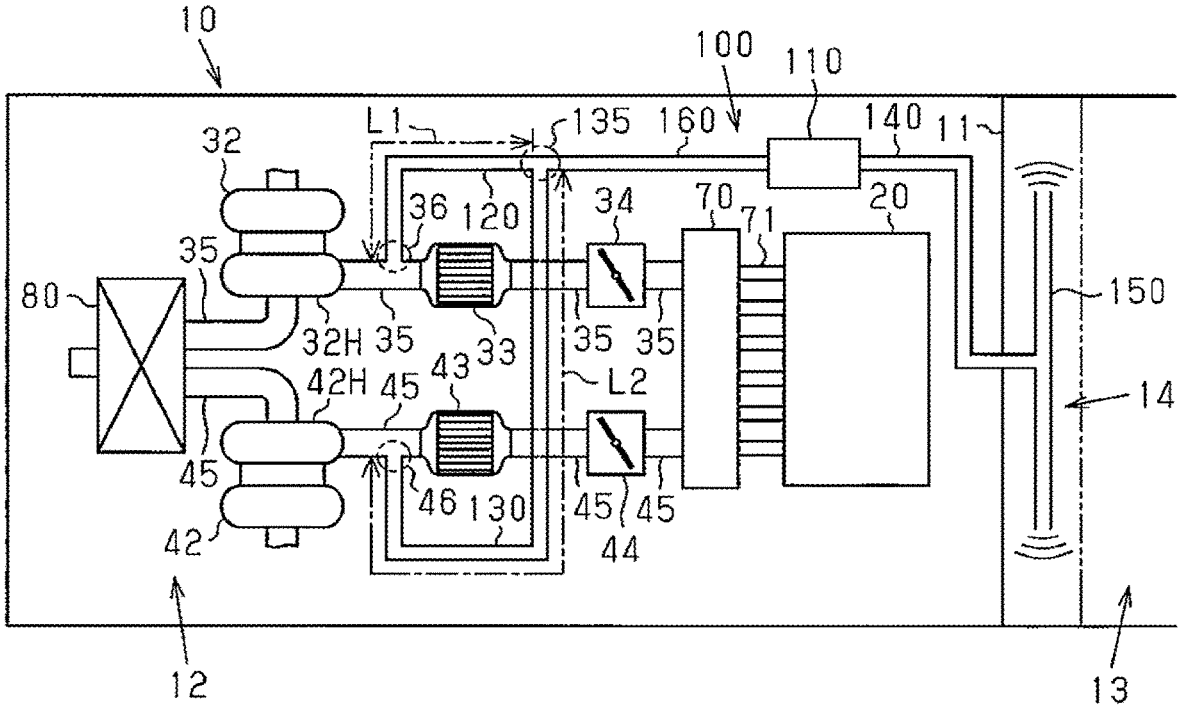
FIG. 2 is a schematic diagram representing an intake system of a vehicle according to a modification.

With reference to FIG. 2, the first intake passage 35 and the second intake passage 45 may have a single air cleaner 80 in common.

Although the engine 20 includes two forced-induction devices, the intake sound introduction device 100 may be employed in an internal combustion engine that includes a single forced-induction device. One such modification is shown in FIG. 3.

Figure 3:
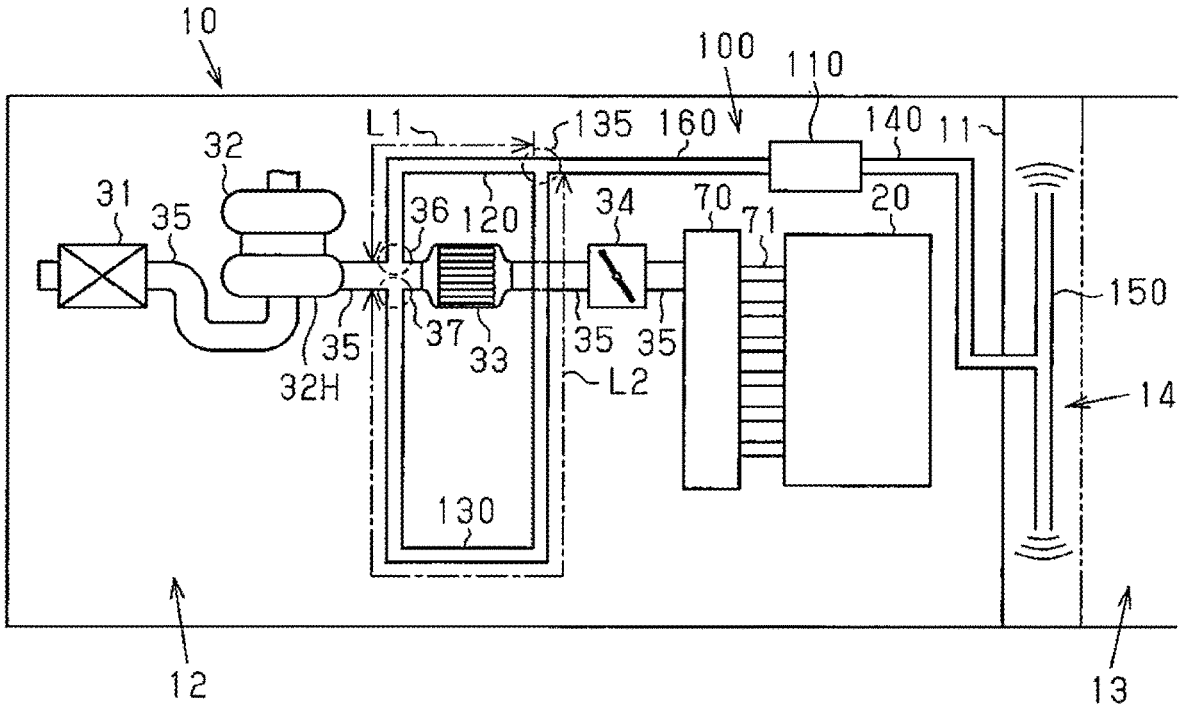
FIG. 3 is a schematic diagram representing an intake system of a vehicle according to another modification.

With reference to FIG. 3, the second intake passage 45, the second air cleaner 41, the second forced-induction device 42, the second intercooler 43, and the second throttle body 44 are omitted from the intake system of the engine 20 of the above-described embodiment. In this case, the second communication pipe 130 is branched from a section of the first intake passage 35 between the first compressor housing 32H and the surge tank 70. For example, the second communication pipe 130 is branched from a section of the first intake passage 35 between the first compressor housing 32H and the first intercooler 33. Also in this case, as long as the second communication pipe 130 is branched from a section of the first intake passage 35 between the first compressor housing 32H and the surge tank 70, the branch point at which the second communication pipe 130 is branched from the first intake passage 35 may be changed as needed. Further, the length of the second communication pipe 130 between a branch point 37, at which the second communication pipe 130 is branched from the first intake passage 35, and the connection point 135, at which the second communication pipe 130 is connected to the first communication pipe 120, is defined as the second length L2. The second length L2 is unequal to the first length L1. Also in this modification, the same operation and advantages as those of the above-described embodiment are achieved.

Although the engine 20 includes the forced-induction devices, the intake sound introduction device 100 may be employed in a naturally aspirated internal combustion engine, which lacks a forced-induction device. One such modification is shown in FIG. 4.

Figure 4:
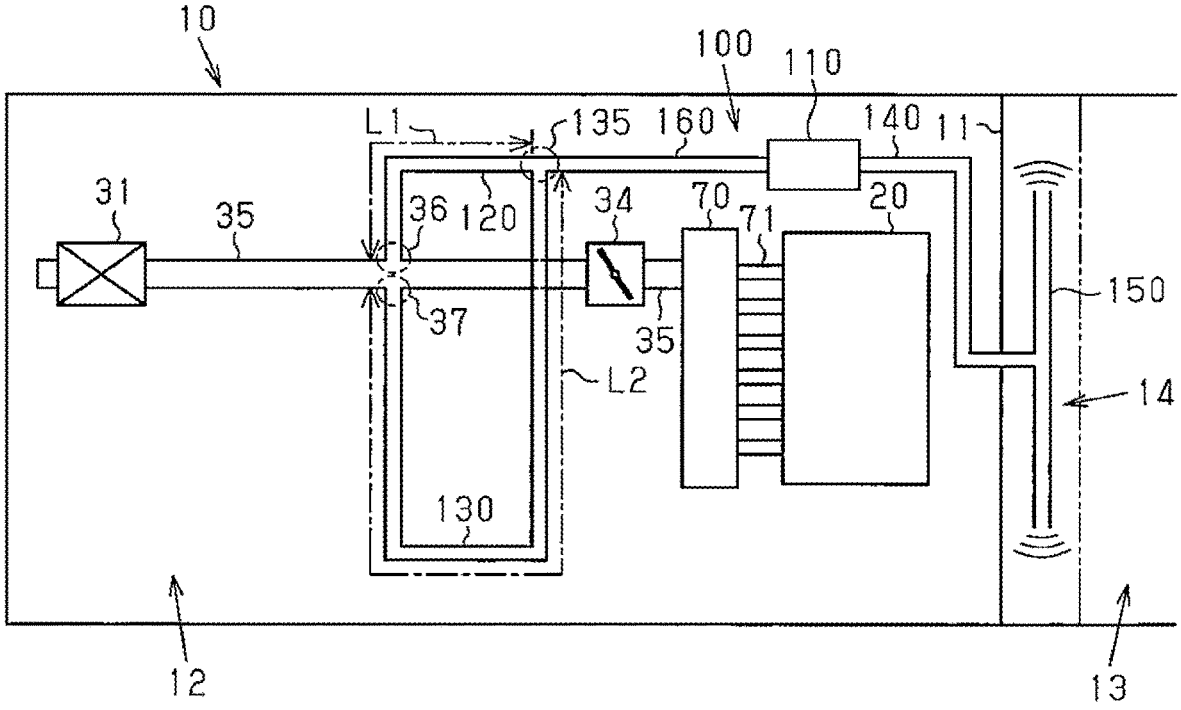
FIG. 4 is a schematic diagram representing an intake system of a vehicle according to another modification.

Referring to FIG. 4, the second intake passage 45, the second air cleaner 41, the second forced-induction device 42, the second intercooler 43, and the second throttle body 44 are omitted from the intake system of the engine 20 of the above-described embodiment. Also, the first forced-induction device 32 and the first intercooler 33 are omitted from the first intake passage 35. The first communication pipe 120 and the second communication pipe 130 are branched from a section of the first intake passage 35 between the first air cleaner 31 and the surge tank 70. Also in this modification, the length of the second communication pipe 130 between the branch point 37, at which the second communication pipe 130 is branched from the first intake passage 35, and the connection point 135, at which the second communication pipe 130 is connected to the first communication pipe 120, is defined as the second length L2. The second length L2 is unequal to the first length L1. As a result, this modification also achieves the advantages of (1) and (3).

The extension pipe 150 is arranged in the dashboard 14. Alternatively, the extension pipe 150 may be arranged in the passenger compartment 13 but outside the dashboard 14. Also in this case, the intake sound that has been amplified by the resonator box 110 may be provided to the interior of the passenger compartment 13.

Figure 5:
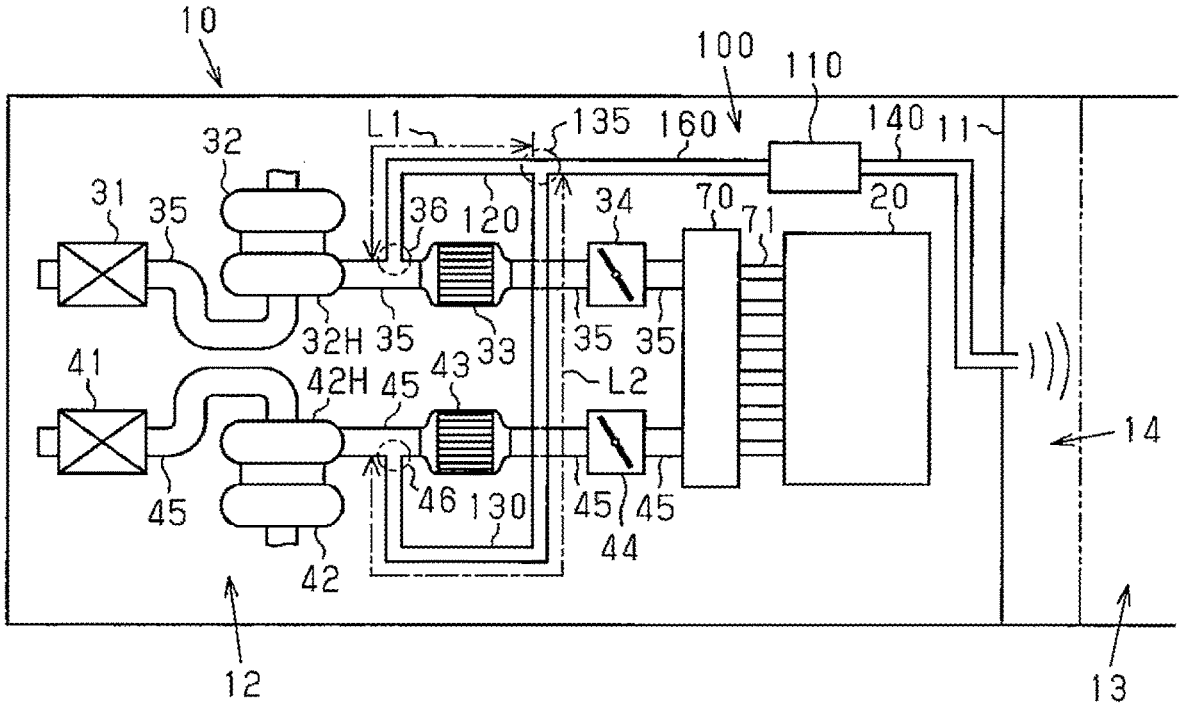
FIG. 5 is a schematic diagram representing an intake system of a vehicle according to another modification.

The extension pipe 150 may be omitted. One such modification is shown in FIG. 5. As illustrated in the drawing, the extension pipe 150 is omitted in this modification. The open end of the transmission pipe 140 that is arranged in the passenger compartment 13 opens in the passenger compartment 13 (for example, in the interior of the dashboard 14). Also in this modification, the intake sound that has been amplified by the resonator box 110 is provided to the interior of the passenger compartment 13 and the advantages (1) and (2) are thus achieved. The extension pipe 150 may also be omitted in the modifications shown in FIGS. 2, 3, and 4.

Although the first forced-induction device 32 and the second forced-induction device 42 are exhaust-driven forced-induction devices, the forced-induction devices may be mechanical forced-induction devices (which are called superchargers) or electric forced-induction devices.

In the above-described embodiment, the second communication pipe 130 is connected to the first communication pipe 120. That is, a single communication pipe is branched from the intake passage and is connected to the first communication pipe 120. Alternatively, two or more communication pipes may be branched from the intake passage and be connected to the first communication pipe 120. Also in this case, one of the communication pipes connected to the first communication pipe 120 is defined as the second communication pipe 130. By forming the second communication pipe 130 to have a second length L2 that is unequal to the first length L1 of the first communication pipe 120, the same operation and advantages as those of the above-described embodiment are achieved.

The invention claimed is:

1. An intake sound introduction device that introduces an intake sound from an internal combustion engine mounted in a vehicle into a passenger compartment, the device comprising:

an intake passage which introduces air into the engine;

an intercooler which is arranged in the intake passage;

a compressor housing which is arranged in the intake passage upstream of the intercooler and which accommodates a compressor of a forced induction device;

a resonator box;

an introduction pipe which introduces the intake sound to the resonator box; and a transmission pipe which allows the resonator box and the interior of the passenger compartment to communicate with each other, wherein the introduction pipe includes a first communication pipe which is branched from the intake passage and is connected to the resonator box, and a second communication pipe which is branched from the intake passage and is connected to the first communication pipe, at least one of the first communication pipe and the second communication pipe are branched from the intake passage between the compressor housing and the intercooler, a length of the first communication pipe between a branch point at which the first communication pipe is branched from the intake passage and a connection point at which the second communication pipe is connected to the first communication pipe is defined as a first length, a length of the second communication pipe between a branch point at which the second communication pipe is branched from the intake passage and the connection point at which the second communication pipe is connected to the first communication pipe is defined as a second length, and the first length is unequal to the second length.

2. The intake sound introduction device according to claim 1, wherein a surge tank is arranged in the intake passage, the compressor housing is arranged in the intake passage upstream of the surge tank, and the first communication pipe and the second communication pipe are branched from the intake passage between the compressor housing and the surge tank.

3. The intake sound introduction device according to claim 2, wherein the intake passage includes a first intake passage and a second intake passage that are independent of each other, the compressor housing of the forced-induction device is one of two compressor housings each arranged in one of the first intake passage and the second intake passage, the first communication pipe is branched from the first intake passage, and the second communication pipe is branched from the second intake passage.

4. The intake sound introduction device according to claim 1, further comprising:

an extension pipe which communicates with an open end of the transmission pipe that is arranged in the passenger compartment, wherein the extension pipe extends in a vehicle width direction in the passenger compartment, and the interior of the extension pipe is exposed to the atmospheric air.

* * * * *